United States Patent [19]

Gimler

[11] 4,298,552

[45] Nov. 3, 1981

[54] SOLVENTLESS EXTRUSION OF DOUBLE BASE PROPELLANT PREPARED BY A SLURRY PROCESS

[75] Inventor: John R. Gimler, Succasunna, N.J.

[73] Assignee: Hercules Incorporated, Wilmington, Del.

[21] Appl. No.: 725,588

[22] Filed: Apr. 29, 1968

[51] Int. Cl.[3] ..... C06B 21/00

[52] U.S. Cl. ..... 264/3 B; 149/95; 149/97; 149/111; 149/76; 149/42

[58] Field of Search ..... 264/3, 3 B; 149/2, 20, 149/38, 42, 76, 95, 97, 111

[56] References Cited

U.S. PATENT DOCUMENTS

| | | | |
|---|---|---|---|
| 3,028,274 | 3/1962 | Winer | 264/3 |
| 3,149,012 | 9/1964 | Preckel | 264/3 X |
| 3,390,210 | 6/1968 | Guenter | 264/3 |

*Primary Examiner*—Stephen J. Lechert, Jr.
*Attorney, Agent, or Firm*—Michael B. Keehan

[57] ABSTRACT

Small charges of high energy double base propellants are prepared by solventless extrusion of propellant billets prepared by a slurry type process.

12 Claims, No Drawings

SOLVENTLESS EXTRUSION OF DOUBLE BASE PROPELLANT PREPARED BY A SLURRY PROCESS

This invention relates to an economical process for producing mass quantities of small double base propellant charges having a propellant web size of from about 0.5 inch to about 4.0 inches.

There are many known processes for manufacturing of double base propellant such as solvent extrusion, conventional casting, slurry casting, and solventless extrusion. None of the above processes is desirable for producing mass quantities of small double base propellant charges when considered in view of either economics or safety, or both.

Solvent extrusion is a highly acceptable process for producing propellant charges having a web size of up to about 0.5 inch. As the propellant web size is increased over 0.5 inch however, solvent removal from the extruded propellant becomes so difficult as to make the process impractical.

Conventional casting is suitable for producing small double base charges of high quality, however the economics of this process make it prohibitive for producing mass quantities of small propellant charges. Precision molds are required in this process and numerous handling operations are involved.

Slurry casting can be used to make small double base propellant charges, but as in conventional casting, precision molds are required which are expensive and many handling operations are involved. Both conventional and slurry casting are primarily employed in production of relatively small quantities of large propellant charges.

Conventional solventless extrusion, while appearing to be a suitable process for manufacturing small double base propellant charges, is an expensive and comparatively hazardous process. Furthermore, the propellant formulations which can be manufactured by this process are somewhat limited. In this process, the desired powder ingredients are mixed in a water slurry, and the slurry dried to the desired water content. The dried slurry is then colloided by rolling of the powder on a combination of rolling mills to produce a colloided sheet of propellant. These sheets are made up into rolls referred to as carpet rolls from which propellant charges are extruded. The rolling step heretofore described is quite hazardous and results in a relatively frequent incidence of fire. For this reason, the newer and more highly sensitive propellant ingredients cannot be incorporated into propellant prepared by this process. Personnel exposure is also quite high because of the numerous hand operations involved in the process.

Modified solventless extrusion processes such as those disclosed in U.S. Pat. No. 3,028,274 while eliminating the necessity for manufacture of carpet roll, require preparation of base grain and casting solvent, and furthermore require precision molds needed for conventional casting with a nitroglycerin type casting solvent.

It is an object of this invention to provide an economical and comparatively safe process for production of mass quantities of small double base propellant charges having a propellant web size of from about 0.5 inch to about 4.0 inches.

It is another object of this invention to provide an economical and comparatively safe process for production of mass quantities of double base propellant charges having incorporated therein highly energetic propellant ingredients.

Other objects of this invention will, in part, be obvious, and will, in part, appear hereinafter. For a complete understanding of the nature and objects of this invention, reference is made to the following detailed description.

Broadly, in accordance with this invention there is provided a process for preparing charges of double base propellant which comprises preparing a pourable propellant slurry comprised of nitrocellulose propellant and a liquid plasticizer for the nitrocellulose propellant, casting the slurry into molds, curing the cast slurry into a solid consolidated mass, and extruding the solid rubbery mass into small propellant charges. The cured slurry which is a solid rubbery mass is referred to hereinafter as a billet.

In one method of preparing a propellant slurry the nitrocellulose propellant employed is comprised of densified nitrocellulose particles. The densified nitrocellulose particles have a dense hard shell of colloidal nitrocellulose forming the surface of each particle. The densified nitrocellulose particles are admixed with sufficient liquid platicizer to form a slurry. These nitrocellulose particles resist plasticization by the liquid plasticizers at ambient temperature allowing a pourable, uniformly mixed slurry to be prepared. Upon heated cure, at a temperature of from about 40° C. to about 60° C., the densified nitrocellulose propellant particles are plasticized by the liquid plasticizer and coalesce to form a solid, consolidated propellant mass.

The densified nitrocellulose particles which can be employed in preparation of the propellant slurry of this invention can have a spheroidal, ellipsoidal, or irregular shape, a particle size ranging from about 1$\mu$ to about 500$\mu$, with a preferred particle size ranging from about 5$\mu$ to about 100$\mu$. The densified nitrocellulose particles have a density of from about 1.4 grams/cc. to about 1.6 grams/cc., and preferably a density of about 1.55 grams/cc.

In an alternative method for preparing a propellant slurry for use in the process of this invention the nitrocellulose propellant is employed in the form of base grain, sometimes referred to in the art as casting powder or smokeless powder. The base grain can be prepared by conventional methods employed in the manufacture of smokeless powder. A slurry is prepared by admixing base grain with a liquid nitrocellulose plasticizer and with a small amount of densified nitrocellulose filler. The resulting slurry is cast, and cured at an elevated temperature of from about 40° C. to about 60° C. until a solid propellant mass is formed. Suitable densified nitrocellulose fillers include densified nitrocellulose particles heretofore described and granules of base grain which are small enough to act as a filler for the larger base grain granules. The amount of densified nitrocellulose filler employed in preparation of the propellant slurry is from about 1% to about 10% by weight based on the weight of the slurry.

In both of the slurry methods heretofore described, various propellant modifiers including stabilizers such as 2-nitrodiphenyl amine, diphenylamine, ethyl centrolite and the like; ballistic modifiers such as lead beta resorcylate, lead salicylate and the like; oxidizing agents such as ammonium perchlorate, cyclotrimethylene trinitramine (RDX), cyclotetramethylene tetranitramine (HMX); and fuels such as finely divided aluminum, beryllium, boron, and metal hydrides can be incorporated. These adjuvants must be either soluble or dispersible within the liquid components of the slurry, or must be uniformly incorporated in the nitrocellulose propellant employed prior to preparation of the slurry. This is necessary in order that a cast propellant of uniform composition is formed. These adjuvants can be incorporated in the slurries as neeed to obtain the proper characteristics for the final propellant charge.

The liquid plasticizers for the nitrocellulose propellant which can be employed to form a propellant slurry with the nitrocellulose propellant include both explosive and non-explosive plasticizers. Suitable explosive plasticizers include nitroglycerin, butane triol trinitrate, diglycol dinitrate, ethylene glycol dinitrate and the like. These explosive plasticizers can be mixed with one or more miscible non-explosive plasticizers such as triacetin, dibutyl phthalate, dimethyl sebacate, dibutyl adipate and the like.

Following preparation of the propellant slurry, the slurry is cast into a mold by any method designed to substantially eliminate entrapment of air in the propellant such as by vacuum casting or bayonet casting. The cast slurry is then cured. The resulting billet is extruded employing conventional solventless extrusion operations. These operations include heating the billet to a predetermined extrusion temperature. When the temperature of the billet is uniform throughout, it is inserted into the chamber of an extrusion press and extruded under vacuum. The billet temperature as well as the extrusion press temperature and operating pressure are functions of each specific billet composition. Optimum extrusion conditions are determined empirically.

The following examples further illustrate the process of this invention. All parts and percentages are by weight unless otherwise specified. The compositions of the slurries of Examples 1–6 are listed in Table I. Press conditions for extrusion of the billets prepared in Examples 1–6 are listed in Table II.

TABLE I (C) Slurry Compositions

| Ingredient, Wt. % | Example 1 | Example 2 | Example 3 | Example 4 | Example 5 | Example 6 |
|---|---|---|---|---|---|---|
| Base Grain | | | | | 56.4* | 53.6* |
| Nitrocellulose (12.6% N) | 50.7 (A) | 9.0 (A) (B) | 9.0 (A) (B) | 19.8 (A) | 4.2 (A) | 9.7 (A) |
| Nitroglycerin | 31.1 | 18.5 | 18.5 | 31.8 | 35.1 | 27.9 |
| 2-Nitrodiphenyl Amine | 2.0 | 1.0 | 1.0 | 1.0 | 1.0 | 0.8 |
| Triacetin | 12.5 | 4.5 | 4.5 | 6.7 | | |
| Candelilla Wax | 0.1 | 0.3 | 0.3 | 0.3 | | |
| Lead Beta Resorcylate | 1.8 | | | | | |
| Lead Salicylate | 1.8 | | | | | |
| Aluminum | | 10.0 (C) | 10.0 (C) | 3.6 (E) | | |
| Lead Oxide ($Pb_3O_4$) | | 49.7 | 50.7 | | | |
| Ammonium Perchlorate | | 6.0 (D) | | 36.0 (F) | | |
| HMX (Cyclo tetramethylene tetranitramine) | | | 6.0 | | | |
| Resorcinol | | 1.0 | | 0.8 | | |
| Di-Normal Propyl Adipate | | | | | 3.3 | 8.0 |

(A) Nitrocellulose densified, $\rho$ = 1.55 grams/cc., 50% micromerograph - 36μ (99.5% passes a 250μ sieve; 96.0% passes a 125μ sieve; 90.0% passes a 74μ sieve)
(B) Nitrocellulose densified, $\rho$ = 1.55–1.58 grams/cc. 50% micromerograph - 10μ
(A) (B) Formulation prepared from both nitrocellulose compositions
(C) 50% Micromerograph - 25μ.
(D) 50% Micromerograph - 220μ.
(E) 50% Micromerograph - 27μ.
(F) Consists of the following mixture (weight %):

| | |
|---|---|
| 50% micromerograph - 220μ; | 18% (unground) |
| 50% micromerograph - 440μ; | 9% (sperical) |
| 50% micromerograph - 15–17μ; | 9% |
| | 36% |

*Base Grain formulation given in Table III.

TABLE II (U) Solventless Extrusion Press Conditions

| | Example 1 | Example 2 | Example 3 | Example 4 | Example 5 | Example 6 |
|---|---|---|---|---|---|---|
| Press Size (Inches) | 4 | 2½ | 2½ | 2½ | 2½ & 4 | 2½ & 4 |
| Propellant billet preconditioning temperature (°F.) | 130–140 | 130 | 130 | 148 | 130 | 132 |
| Press Basket Temperature (°F.) | 130–140 | 130–150 | 130–150 | 140 | 130 | 128 |
| Die Temperature (°F.) | 185–195 | 180 | 180 | 190 | 185 | 182 |
| Extrusion Pressure (psi) | 800–1000 | <100 | <100 | 250 | 1100 | 850 |
| Extrusion Rate (inches/minute) | 8–10 | 8–10 | 8–10 | 8–10 | 7.4 | 7.5 |
| Die Inside Diameter (inches) | 1.250 | 0.511 | 0.511 | 0.150 | 0.250 | 0.250 |
| Die Stake Diameter (inches) | 0.510 | | | | 0.510 | 0.510 |

EXAMPLE I

A pourable propellant slurry is prepared having the composition listed for Example 1 in Table I.

In preparing the pourable slurry, lead beta resorcylate, lead salicylate, and candelilla wax are predispersed in triacetin in a ball mill and added to the mixer. The nitroglycerin and nitrocellulose are added in turn to the mixer and the resulting pourable slurry mixed under a vacuum of less than 10 mm. Hg for about 30 minutes. The pourable slurry is cast into a 3¾ inch polypropylene tube closed at the bottom with a rubber stopper. The cast propellant is cured for 10 days at a temperature of 130° F. to 135° F. The resulting propellant billets are removed from the polypropylene molds and temperature conditioned for extrusion.

The billets are extruded at the conditions listed in Table II. Propellant strands having diameters of 0.25 inch and 0.50 inch are extruded. Additional strands are extruded having a perforated cylindrical cross section and having an outside diameter of 1.25 inches and an inside diameter of 0.50 inch.

The propellant strands are of excellent quality, have perfect consolidation and smooth surfaces. The propellant strands having 0.25 inch diameter are cut into 5 inch lengths and ballistically tested in a strand burner. The perforated propellant extrusions are cut into 1-inch lengths and ballistically tested in a heavyweight rocket test motor. Ballistic performance of these charges is excellent and is substantially the same as that of a conventionally cast grain of the same composition and geometry.

The following example illustrates the adaptability of this process to solventlessly extrude a slurry cast double base propellant billet containing ammonium perchlorate and finely divided aluminum.

EXAMPLE 2

A propellant slurry is prepared having the composition listed in Table I.

In preparing the pourable slurry, candelilla wax, 2-nitrodiphenyl amine and resorcinol are dissolved and dispersed in triacetin and added to the slurry mixer. Nitroglycerin, aluminum, ammonium perchlorate, lead oxide and nitrocellulose are added to the mixer in the above order, with about five minutes mixing in between each addition. The resulting slurry is mixed under a vacuum of less than 10 mm. Hg for about 30 minutes. The pourable slurry mixture is cast under vacuum into plastic tube molds closed at the bottom with a rubber stopper and cured for five days at 130°-140° F. The resulting propellant billets are removed from the molds and conditioned for extrusion at 130° F.

The billets are extruded at the conditions listed in Table II in the form of a continuous ½ inch diameter solid rod. The extruded solid rod of propellant is of excellent quality, shows perfect consolidation, and has a smooth surface.

The following example illustrates extrusion of a slurry cast propellant containing both finely divided aluminum and a high explosive oxidizer.

EXAMPLE 3

A propellant slurry is prepared having the composition listed in Table I.

In preparing the pourable slurry, candelilla wax and 2-nitrodiphenyl amine are dispersed and dissolved respectively in triacetin with use of a ball mill, and then added to the slurry. Nitroglycerin, aluminum, HMX, lead oxide, and nitrocellulose are added in turn to the mixer with about five minutes of mixing in between each addition. The resulting slurry is mixed under a vacuum of less than 10 min. Hg for about 30 minutes. The pourable slurry is cast under vacuum into a 2¼ inch polypropylene tube with the bottom closed by a rubber stopper. The cast slurry is cured for five days at 130°-140° F. The resulting propellant billet is a solid, rubbery or plastic mass.

The billet is removed from the mold and temperature conditioned for extrusion. The billet is extruded into a ½ inch diameter rod at conditions listed in Table II. The extruded rod is of excellent quality, shows perfect consolidation, and has a smooth surface.

The following example illustrates the feasibility of employing this process for producing propellant charges having a high energy formulation known as "Very High Impulse Composite Modified Double Base."

EXAMPLE 4

A propellant slurry is prepared having a composition as listed in Table I.

In preparing the pourable slurry, a trimodal mixture of ammonium perchlorate is preblended. 2-Nitrodiphenyl amine is dissolved in triacetin at 130° F. and the resulting solution charged to the slurry mixer. Resorcinol, nitroglycerin and aluminum are then each added to the mixer in the order listed. Following addition of the aluminum, the preblended ammonium perchlorate is added to the mixer in three equal increments with about ten minutes of mixing following each addition. The candelilla wax and nitrocellulose are then added to the mixer. The resulting slurry is mixed for about 10 minutes at atmospheric pressure and for about 20 minutes under a vacuum of less than 10 mm. Hg. The pourable slurry is cast under vacuum into a polypropylene mold and cured for 10 days at 130°-140° F. The resulting billet is extruded at conditions listed in Table II into the form of a continuous 0.150 inch diameter strand. The extruded propellant is of excellent quality, shows perfect consolidation, and has a smooth surface.

TABLE III

| Ingredient | Base Grain Formulation Example 5 (Wt. %) | Example 6 (Wt. %) |
|---|---|---|
| Nitrocellulose (12.6% N) | 84.3 | 74.1 |
| Nitroglycerin | 5.6 | 17.0 |
| 2-Nitrodiphenyl amine | 1.9 | 2.0 |
| Lead Beta Resorcylate | 3.8 | 3.0 |
| Basic Cupric Salicylate | 3.8 | — |
| Candelilla Wax | 0.6 | 0.6 |
| Lead Salicylate | — | 3.0 |
| Carbon Black | — | 0.3 |

The following example illustrates an alternate procedure for the preparation of a pourable slurry of propellant. In this procedure, a base grain is prepared. The base grain is admixed with sufficient casting solvent to result in a pourable slurry of desirable composition. The remainder of the process is as previously described.

EXAMPLE 5

Solid propellant billets are prepared from a propellant slurry comprised of a base grain and a casting solvent. The slurry has the composition listed in Table I.

The base grain having the formulation listed in Table III is prepared by admixing the base grain ingredients with 45 parts of a 40/60 mixture of ethyl alcohol and acetone per 100 parts of base grain ingredients. Standard base grain or smokeless powder manufacturing procedures are employed. The admixture is mixed until a smooth colloid is formed (approximately three hours) and the resulting dough is extruded from a solvent press through a 0.030 inch die, and cut (33 cuts per lineal inch). The cut base grain is dried to a moisture and volatiles content of less than 0.8%.

In preparing the slurry, 2-nitrodiphenyl amine (2-NDPA) is first admixed in di-normal propyl adipate. The admixture is heated to 130° F. whereby all the 2-NDPA dissolves. The admixture is cooled to 90° F., nitroglycerin added, and the resulting solvent mixture agitated with air sparging. This solvent mixture is charged to a vertical mixer and one-half the quantity of base grain is added thereto and mixed for three minutes. Densified nitrocellulose filler in the form of densified particles of nitrocellulose is then added to the mixer and mixing continued for another three minutes. The remaining base grain is then added to the mixer and after three minutes additional mixing, the resulting propellant slurry is subjected to a vacuum of less than 10 mm. Hg. The propellant slurry is mixed an additional 30 minutes and cast under vacuum into a 3¾ inch inside diameter polypropylene tube. The cast propellant is cured for four days at about 135° F. The resulting propellant billet is removed from the mold.

The billet is extruded at conditions set forth in Table II. The extruded propellant is of excellent quality, shows perfect consolidation, and has a smooth surface. Propellant charges prepared from this propellant have been fired with excellent ballistic reproducibility.

The following example is another illustration of the process of this invention employing the alternate procedure of preparing a slurry of propellant from base grain and a casting solvent.

EXAMPLE 6

Solid billets of propellant are prepared having the composition listed in Table I. These billets are prepared from base grain having the formulation listed in Table III.

The base grain is prepared by admixing the base grain ingredients, employing standard base grain or smokeless powder manufacturing procedures, in the presence of 80 parts of a 35/65 mixture of ethyl alcohol and ethyl ether per 100 parts of base grain ingredients. After about three hours of mixing, a smooth colloid is formed, and the resulting dough is extruded from a solvent type press through a 0.041 inch die. The solvent wet strands are cut (30 cuts per lineal inch) and dried one day at 35° C. and four days at 55° C., yielding base grain having a final moisture and volatiles content of less than 0.8%.

The pourable slurry is prepared in the same manner with the same ingredient addition steps and mixing times as the slurry prepared in Example 5. The resulting pourable slurry is cast under vacuum into 3¾ inch polypropylene tubes and cured for four days at about 135° F. The resulting billet is extruded at the conditions set forth in Table II.

The extruded propellant is of excellent quality, shows perfect consolidation, and has a smooth surface. The pressure versus burning rate for propellant prepared by this process is substantially the same as for propellant prepared by conventional casting.

The molds in which the propellant slurries are cast can be prepared from any nitroglycerin resistant materials which are dimensionally stable at curing temperatures. A particularly suitable material for these molds is polypropylene. The molds are prepared by injection molding of polypropylene in the form of a tube. These tubes are fitted with a rubber stopper at the bottom. The molds are inexpensive and are reusable. Savings realized from the ability to use such molds is an important factor in the economics of the process of this invention.

Another economic advantage of this process is that highly accurate mold filling equipment such as is required for conventional casting is not required. Accuracy in filling the molds need only be controlled to the extent that the resulting billet does not exceed the length of the basket of the press in which the billet is to be extruded. Mold filling is therefore greatly simplified so that personnel exposure and equipment costs are minimized.

Another advantage of the process of this invention is that the solvent extrusion step upgrades the mechanical properties of the slurry cast propellant. The mechanical properties of the final propellant charges prepared by the process of this invention are substantially equivalent to the mechanical properties of solventless extruded and conventionally cast propellant charges.

As will be evident to those skilled in the art, various modifications can be made or followed, in light of the foregoing disclosure and discussion, without departing from the spirit or scope of the disclosure or from the scope of the claims.

What I claim:

1. A process for preparing double base propellant charges comprising:

(a) preparing a pourable slurry comprised of nitrocellulose propellant and a liquid platicizer for the nitrocellulose propellant, (b) casting the slurry into molds, (c) curing the cast slurry into a solid mass, and (d) extruding the solid mass into a small propellant charges.

2. The process of claim 1 wherein the nitrocellulose propellant is comprised of particles of densified nitrocellulose.

3. The process of claim 2 wherein the liquid plasticizer for the nitrocellulose propellant is comprised of nitroglycerin.

4. The process of claim 3 wherein the densified nitrocellulose particles have a particle size of from about 5μ to about 100μ.

5. The process of claim 4 wherein the slurry is cast under vacuum and cured at an elevated temperature of from about 40° C. to about 60° C. until the nitrocellulose propellant forms a solid mass.

6. The process of claim 5 in which the propellant slurry contains finely divided aluminum, and ammonium perchlorate.

7. The process of claim 1 wherein the nitrocellulose propellant is comprised of smokeless powder and the propellant slurry contains from about 1% to about 10% by weight of a densified nitrocellulose filler.

8. The process of claim 7 wherein the liquid plasticizer for the nitrocellulose propellant is comprised of nitroglycerin.

9. The process of claim 8 wherein the slurry is cast under vacuum and cured at an elevated temperature of from about 40° C. to about 60° C. until the nitrocellulose propellant forms a solid mass.

10. The process of claim 9 wherein the slurry contains aluminum and ammonium perchlorate predispersed in the smokeless powder.

11. The process of claim 10 wherein the densified nitrocellulose filler is small particles of densified nitrocellulose.

12. The process of claim 6 wherein the densified nitrocellulose filler is small granules of smokeless powder.

* * * * *